US008813939B2

(12) United States Patent
Valleree et al.

(10) Patent No.: US 8,813,939 B2
(45) Date of Patent: Aug. 26, 2014

(54) PRE-COLLECTION DEVICE FOR A PAYMENT TERMINAL

(71) Applicant: Parkeon, Paris (FR)

(72) Inventors: Philipp Valleree, Sornay (FR); Sylvain Braun, Routelle (FR)

(73) Assignee: Parkeon, Paris (FR)

( * ) Notice: Subject to any disclaimer, the term of this patent is extended or adjusted under 35 U.S.C. 154(b) by 0 days.

(21) Appl. No.: 13/826,350

(22) Filed: Mar. 14, 2013

(65) Prior Publication Data

US 2014/0021008 A1 Jan. 23, 2014

(30) Foreign Application Priority Data

Jul. 20, 2012 (FR) ..... 12 57077

(51) Int. Cl.
*G07D 11/00* (2006.01)

(52) U.S. Cl.
CPC ..... *G07D 1/043* (2013.01); *G07D 11/0018* (2013.01)
USPC ..... 194/203

(58) Field of Classification Search
CPC ..... G07D 11/00; G07D 11/0018; G07F 1/00; G07F 1/02; G07F 1/043
USPC ..... 194/203; 232/55, 57, 58, 65
See application file for complete search history.

(56) References Cited

U.S. PATENT DOCUMENTS 3,285,382 A * 11/1966 Williams, III ..... 194/203
4,841,563 A * 6/1989 Sano et al. ..... 379/150

FOREIGN PATENT DOCUMENTS

DE 7829505 U1 2/1979
DE 8800768 U1 3/1989
GB 2005890 A 4/1979

OTHER PUBLICATIONS

French Search Report, dated Jan. 10, 2013, from corresponding FR application, (3 pages).

* cited by examiner

*Primary Examiner* — Mark Beauchaine
(74) *Attorney, Agent, or Firm* — Young & Thompson

(57) ABSTRACT

A pre-collection device (4) for pre-collecting coins, intended for a payment terminal (1), the pre-collection device (4) including a frame (6), a bucket (8) having an inlet opening (14) for inserting coins into the bucket (8) and an outlet opening (26) for removing coins stored in the bucket (8). The pre-collection device (4) further includes at least one cutting blade (36) that is movable relative to the frame (6) between an idle position and an active position and that is at least partially movable across the inlet opening (14) between the idle position and the active position, and a mechanism for moving the movable cutting blade (36), capable of moving the movable cutting blade (36) from its idle position to its active position so as to cut the object engaged in the inlet opening (14) of the bucket (8).

10 Claims, 3 Drawing Sheets

PRE-COLLECTION DEVICE FOR A PAYMENT TERMINAL

The present invention relates to a pre-collection device for pre-collecting coins, intended for a payment terminal, the pre-collection device comprising a frame, a bucket having an inlet opening for inserting coins into the bucket, and a discharge opening for discharging coins stored in the bucket.

BACKGROUND OF THE INVENTION

One fraud method commonly used in payment terminals authorizing payment by coins consists of attaching the coin to one end of a thread, before inserting it into the payment terminal using the insertion slot provided for that purpose. The coin attached to the end of the thread then enters the money selector and falls into the pre-collection bucket. When the transaction is validated, the bucket moves to its payment position, in which the coins it contains are normally discharged toward the moneybox under the effect of gravity. However, the coin in question being attached to the end of a thread whereof the opposite end is held by the perpetrator of the fraud, it cannot be discharged toward the moneybox and remains in the bucket. The perpetrator of the fraud then performs a second transaction, during which he inserts the new coin and releases the thread. The coin newly inserted, as well as the coin attached to his thread, fall onto the bottom of the bucket. The perpetrator of the fraud then cancels the transaction so that the bucket moves to its coin return position and discharges the two coins to the bowl, where they are recovered by the perpetrator of the fraud.

This fraud system thus allows the perpetrator to obtain parking authorization at no cost for a length of time corresponding to the amount of the first inserted coin.

It is possible to detect such fraud by providing optomechanical sensors in the payment terminals, those sensors being capable of detecting the presence of the thread. However, such a detection system is not fully satisfactory. In fact, its effectiveness is limited to rigid and/or tensioned threads.

It is also possible to add flaps at the slot for inserting coins into the payment terminal. These flaps are designed to prevent a thread from being passed into the slot. Such an anti-fraud system is also not fully satisfactory. Indeed, it is visible and accessible from outside the terminal, which makes it easier for a person intending to commit fraud to bypass or neutralize.

SUMMARY OF THE INVENTION

One aim of the invention is to propose a pre-collection device comprising a system making it possible to guarantee collection of the coins inserted into the payment terminal when the transaction is validated, and that is also simple and inexpensive to implement.

To that end, the invention relates to a pre-collection device as described above, which comprises at least one cutting blade that is movable relative to the frame between an idle position and an active position and that is at least partially movable across the inlet opening between the idle position and the active position, and a moving mechanism for moving the movable cutting blade, capable of moving the movable cutting blade from its idle position to its active position so as to cut an object engaged in the inlet opening of the bucket.

The invention may also comprise one or more of the following features, considered alone or according to all technically possible combinations:

- the movable cutting blade is configured to move in the plane of the inlet opening of the bucket,
- the movable cutting blade is configured to sweep only one end of the inlet opening when it is moved between its idle position and its active position,
- the bucket is pivotably mounted relative to the frame around a bucket pivot axis between a pre-collection position, in which it defines a temporary storage volume for the coins, and a discharge position for discharging coins through the discharge opening toward a moneybox of the payment terminal, the moving mechanism for moving the movable cutting blade being capable of moving the movable cutting blade from its idle position to its active position under the action of the movement of the bucket from its pre-collection position to its discharge position,
- the movable cutting blade is pivotably mounted relative to the frame around a pivot axis between its idle position and its active position,
- the moving mechanism comprises a cam secured to the bucket and a cam follower secured to the movable cutting blade, the pivoting of the cam around the pivot axis of the bucket being capable of causing the cam follower to pivot around the pivot axis of the movable blade,
- the pre-collection device further comprises an elastic return member capable of moving the movable cutting blade from its active position to its idle position,
- the pre-collection device further comprises a counter-blade that is stationary relative to the frame, arranged to shear the object between the counter-blade and the movable cutting blade, and
- the pre-collection device further comprises pre-stressing means, capable of pressing the movable cutting blade against the counter-blade along a direction normal to the movement plane of the movable cutting blade.

The invention also relates to a payment terminal comprising a pre-collection device as defined above.

BRIEF DESCRIPTION OF THE DRAWINGS

The invention will be better understood upon reading the following description, which is provided solely as an example and done in reference to the appended drawings, in which.

DETAILED DESCRIPTION OF THE PREFERRED EMBODIMENTS

Figure 1:
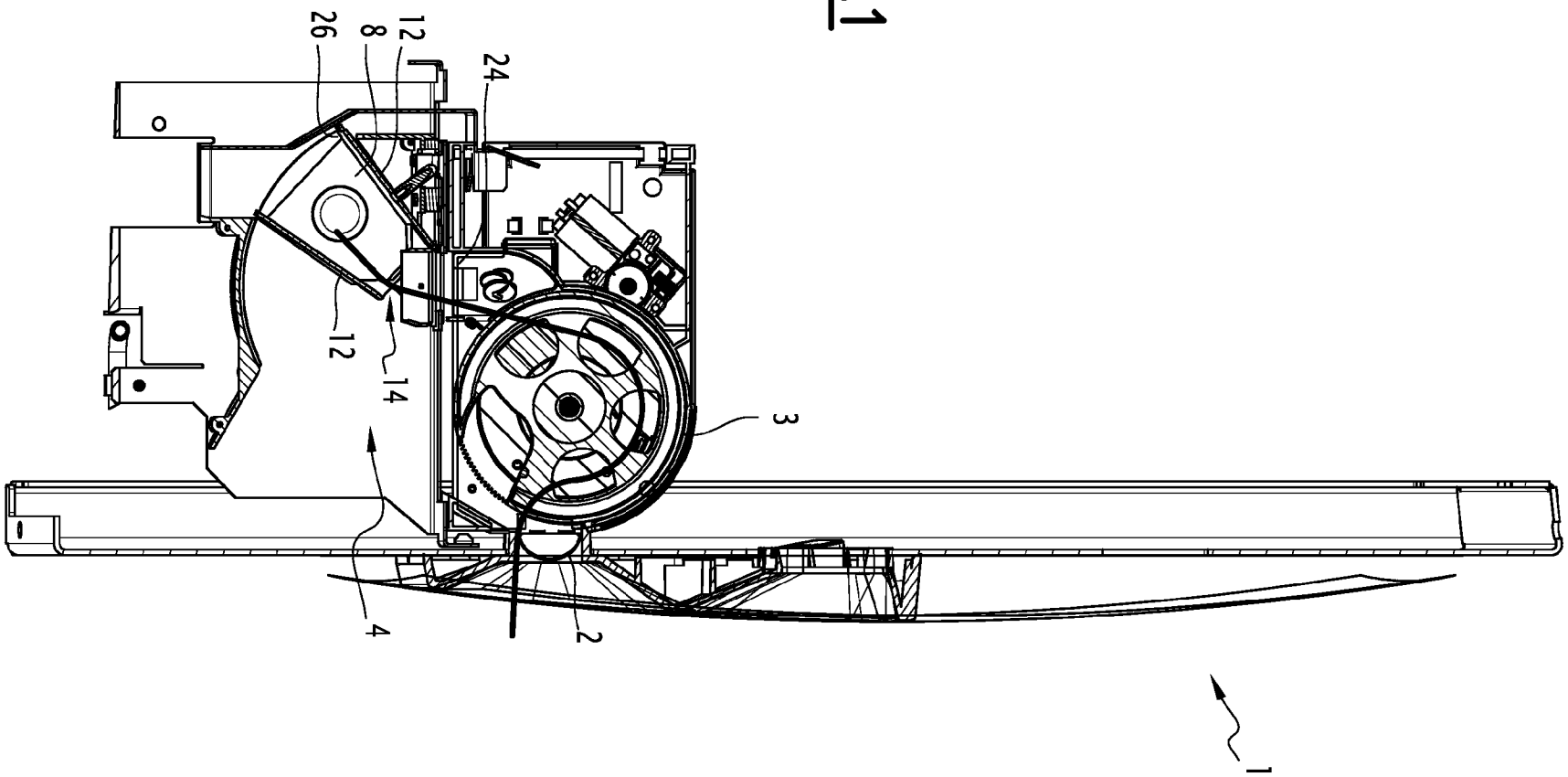
FIG. 1 is a diagrammatic cross-sectional view of part of the payment terminal comprising a pre-collection device according to the invention, the bucket being in its discharge position for discharging coins toward the moneybox, i.e., in the coin collection position.

FIG. 1 diagrammatically illustrates part of a payment terminal 1 comprising a pre-collection device according to the invention.

A payment terminal refers to a device designed to provide a product or service in exchange for payment made in particular using coins. That device may for example be a parking meter or a transportation ticket dispenser.

As illustrated in FIG. 1, the payment terminal 1 successively comprises, following the path of the coin in the payment terminal 1:

a slot 2 for inserting coins into the payment terminal;

a coin selector 3, arranged downstream from the insertion slot 2, and configured to eliminate noncompliant coins and convey the accepted coins toward the pre-collection device 4; and the pre-collection device 4, in which the coins are temporarily stored while waiting for an order from the user indicating whether the user wishes to continue the transaction, and which will be described in more detail hereafter.

If the transaction is validated, the coins are directed toward a moneybox, not shown, in which the coins are permanently stored until the next collection.

If, on the contrary, the transaction is canceled, the coins are returned to the user through a return compartment, not shown.

Figure 2:
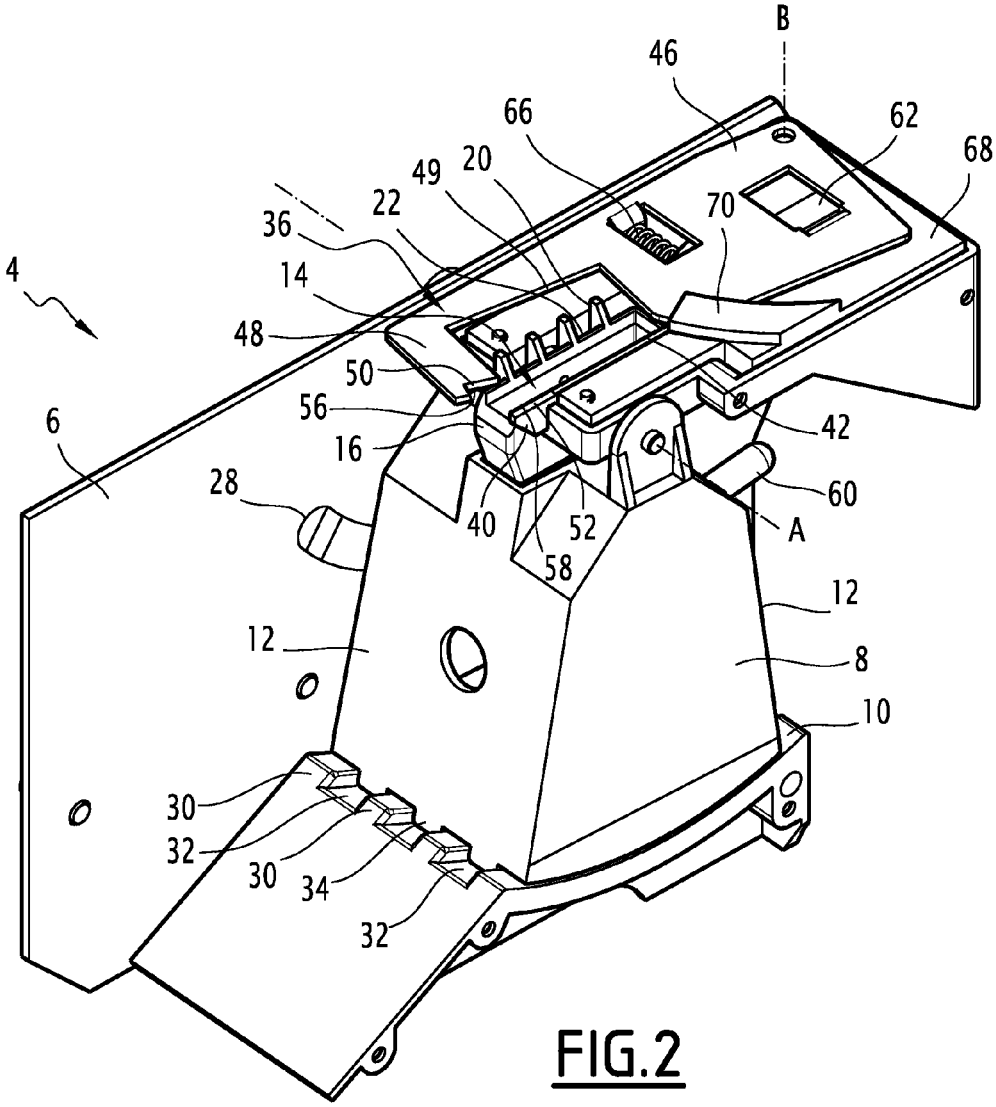
FIG. 2 is a diagrammatic perspective view of the pre-collection device according to the invention, the bucket being in its pre-collection position.
Figure 3:
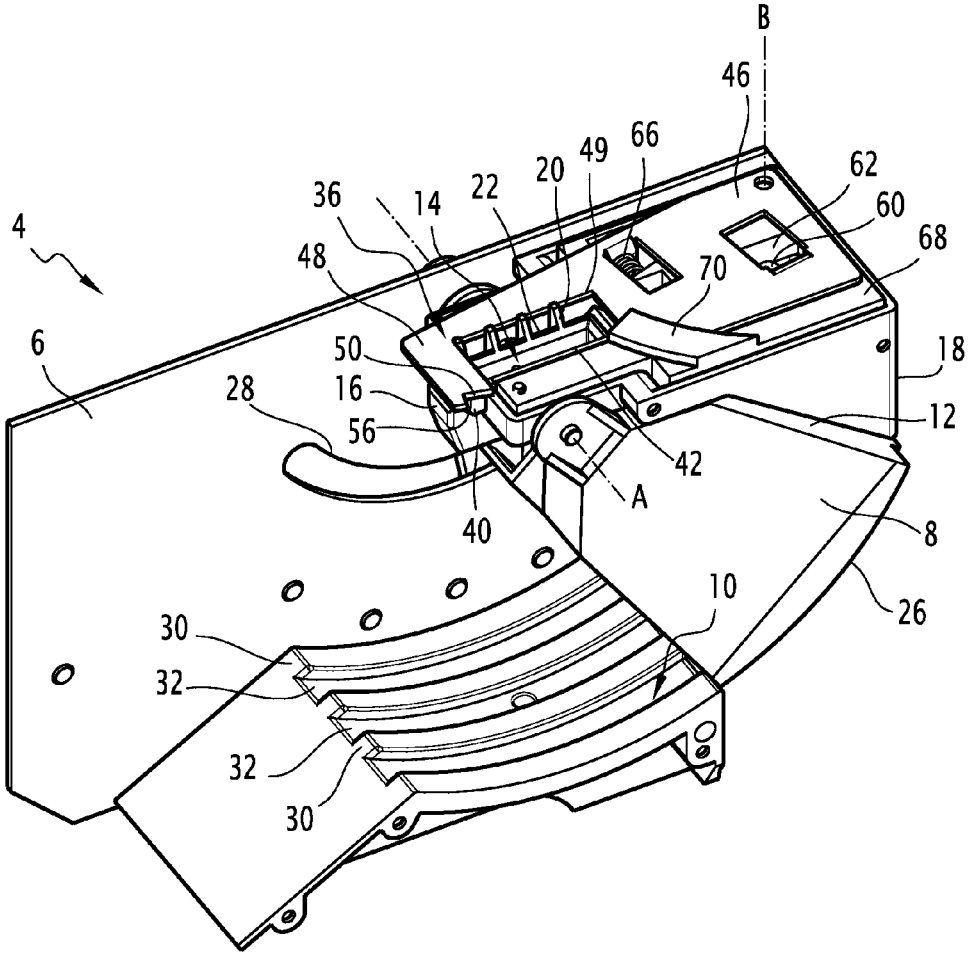
FIG. 3 is a diagrammatic view similar to FIG. 2, the bucket being in its discharge position toward the moneybox.

The pre-collection device 4 according to the invention is illustrated in more detail in FIGS. 2 and 3.

It comprises:

a frame 6 fixed in the payment terminal 1;

a bucket 8 for temporarily storing the coins coming from the selector 3 before reception of the order from the user to validate or cancel the transaction; and a temporary storage platform 10 on which the coins contained in the bucket 8 rest.

As shown in FIG. 2, the bucket 8 is for example in the general shape of a bell comprising two side walls 12 diverging downward.

In its upper portion, it comprises a coin inlet opening 14. This inlet opening 14 is configured to receive the coins coming from the selector 3 and cause them to enter the bucket 8. It is elongated in a longitudinal direction. It is for example in the shape of a slot, in particular rectangular.

In the illustrated example, the upper portion of the inlet opening 14 comprises a conduit 16 that is stationary relative to the frame 6 and forms part of a support piece 18 for the bucket 8 secured to the frame 6.

Optionally, teeth 20 for guiding the coins are distributed along a longitudinal edge 22 of the inlet opening 14. They guide the coins coming from the outlet opening 24 of the selector 3 into the inlet opening 14. These guide the inlet opening 14 teeth 20 protrude upward from the inlet opening 14. They are in particular formed on an upper edge of the conduit 16 and extend upward from that conduit 16.

The lower portion of the bucket 8 comprises a discharge opening 26 for discharging coins.

The bucket 8 is mounted pivotably relative to the frame 6 around a bucket pivot axis denoted A between a pre-collection position, illustrated in FIG. 2, in which it defines, with the platform 10, a temporary storage volume for the coins, and a discharge position for discharging the coins through the discharge opening 26 toward the moneybox, illustrated in FIG. 3. In the example shown in the figures, the pivot axis A is a horizontal axis. It is arranged in the upper portion of the bucket 8.

The pre-collection device 4 also comprises means for moving the bucket 8 (not shown), configured to move the bucket 8 between its pre-collection position and its discharge position. These movement means are traditional, and will therefore not be described in more detail.

In the illustrated example, the frame 6 comprises a slot 28, for example in the form of an arc of circle, for guiding the bucket 8 when it moves between its different positions.

In the illustrated example, the platform 10 comprises longitudinal ribs 30 on its face oriented toward the inside of the bucket 8. These ribs 30 delimit slots 32 between them which cooperate with complementary teeth 34 formed on the bucket 8 so as to push the coins stored in the bucket 8 out of the platform 10 when the bucket 8 pivots toward its discharge position.

In the pre-collection position illustrated in FIG. 2, the platform 10 completely covers the discharge opening 26 of the bucket 8 and forms, with said bucket 8, a temporary storage volume for the coins.

In the discharge position for discharging the coins toward the moneybox, i.e., in the collection position, illustrated in FIG. 3, the discharge opening 26 of the bucket 8 is completely freed. In that position, the coins contained in the temporary storage volume, pushed out of the platform 10 due to the movement of the bucket 8 toward its discharge position, are freed by gravity through the discharge opening 26 toward the moneybox. In the figures, the discharge position corresponds to a position of the bucket 8 pivoted to the right relative to the pre-collection position.

The pre-collection device 4 is equipped with an anti-fraud system comprising:

at least one cutting blade 36 that is movable relative to the frame 6 between an idle position and an active position, and a moving mechanism for moving the movable cutting blade 36, capable of moving that blade 36 from its idle position to its active position so as to cut an object engaged in the inlet opening 14 of the bucket 8.

This object is more particularly a thread connecting a coin contained in the bucket 8 to the slot 2 for inserting coins into the payment terminal 1. The position of the thread in the inlet opening 14 is determined by the relative positions of the coin outlet opening 24 of the selector 3 and the inlet opening 14 of the bucket 8. The thread is engaged in the inlet opening 14 at an engagement area. In the illustrated example, this engagement area is situated at a longitudinal end of the inlet opening 14.

In the illustrated example, the anti-fraud system is completely comprised within an outer housing of the payment terminal 1.

The movable blade 36 is in its idle position when the bucket 8 is in its pre-collection position. It is in its active position when the bucket 8 is in its discharge position.

In the illustrated example, the moving mechanism is capable of moving the movable cutting blade 36 from its idle position to its active position under the action of the movement of the bucket 8 from its pre-collection position to its discharge position. Thus, the bucket 8, through its movement from its pre-collection position to its discharge position, causes the movable cutting blade 36 to move from its idle position to its active position by means of the moving mechanism.

As illustrated in FIGS. 2 and 3, the anti-fraud system also comprises a counter-blade 40 that is stationary relative to the frame 6. The movable blade 36 is movably mounted relative to the counter-blade 40. The blade 36 and the counter-blade 40 are arranged at the inlet of the bucket 8, at a height higher than that of the inlet opening 14.

The blade 36 is configured to cooperate with the counter-blade 40 to cut the thread engaged in the inlet opening 14. The blade 36 and the counter-blade 40 cooperate like the blades of a pair of scissors to cut the thread by shearing.

The counter-blade 40 is arranged such that the blade 36 slides on the counter-blade 40 when it moves from its idle position to its active position. The blade 36 and the counter-blade 40 are capable of shearing, between them, the thread engaged in the inlet opening 14 when the blade 36 slides on the counter-blade 40.

In the illustrated example, the blade 36 is mounted pivotably relative to the frame 6 around a pivot axis denoted B between its idle position and its active position. That axis B is vertical.

The blade 36 is at least partially movable across the inlet opening 14 between the idle position and the active position. In the illustrated example, it is configured to sweep only one area of the inlet opening 14, i.e., the longitudinal end on the side of the inlet opening 14 where the thread connected to a coin received in the bucket 8 is engaged in the inlet opening 14.

The blade 36 and the counter-blade 40 will now be described in more detail with reference to FIGS. 2 and 3.

In the illustrated example, the blade 36 is substantially planar. It extends in a substantially horizontal plane, in particular at a height greater than that of the inlet opening 14. The counter-blade 40 is positioned along a plane substantially normal to the plane of the blade 36. It is positioned along an edge 42 of the inlet opening 14.

The blade 36 comprises an actuating area 46 and a cutting area 48. The actuating area 46 is pivotably mounted on the frame 6. The cutting area 48 forms one end of the blade 36 away from the pivot axis B. In the illustrated example, the blade 36 comprises, between the cutting area 48 and the actuating area 46, a recess 49 capable of allowing the passage of the teeth 20 when the blade 36 moves to its active position.

More particularly, in the illustrated example, the cutting area 48 bears a cutting surface 50 oriented toward the counter-blade 40 and intended to cooperate with a cutting surface 52 of the counter-blade 40 to cut the thread engaged in the inlet opening 14.

In the illustrated example, the cutting surface 50 has a length smaller than the length of the inlet opening 14. Thus, the cutting surface 50 only extends over part of the inlet opening 14.

In the illustrated example, the cutting surface 50 of the blade 36 is in the shape of a V or L oriented toward the inlet opening 14. Owing to this particular form, the blade 36 is capable, when it is moved to its active position, of grasping the thread engaged in the inlet opening 14, and guiding it against the counter-blade 40. This V shape also maintains the thread in contact with the counter-blade 40 and the blade 36 to guarantee sectioning of that thread by shearing when the movable cutting surface 50 crosses the stationary cutting surface 52 by sliding thereon during its movement toward its active position.

The cutting surface 50 of the blade 36 comprises a movable cutting edge 56 designed to cooperate with a stationary cutting edge 58 of the counter-blade 40 so as to cut the thread. The movable cutting edge 56 is configured to slide on the stationary cutting edge 58 when the blade 36 is moved to its active position. This crossing causes sectioning of the thread caught between the stationary cutting edge 58 and the movable cutting edge 56. Thus, the movable cutting edge 56 slides on the stationary cutting edge 58 while being in contact therewith.

The blade 36 and the counter-blade 40 are for example made from metal, in particular stainless steel.

In the illustrated example, the blade 36 and the counter-blade 40 are keen. The stationary and movable cutting edges 58, 56 are sharp.

The movable cutting edge 56 extends substantially in the movement plane of the blade 36, i.e., in the plane of the inlet opening 14.

It is formed by the intersection between a planar lower surface of the movable cutting blade 36 and a portion of the cutting surface 50 inclined upwardly away from the inlet opening 14. That inclined surface in particular forms an angle larger than 90°, in particular approximately equal to 100°, with the lower surface of the movable cutting blade 36. The movable cutting edge 56 thus forms the leading edge of the cutting surface 50 of the blade 36.

In the illustrated example, the length of the movable cutting edge 56 is smaller than the length of the inlet opening 14.

The stationary cutting surface 52 is formed by an upper surface of the counter-blade 40. The stationary cutting edge 58 is formed by the intersection between the stationary cutting surface 52 and a substantially vertical surface of the counter-blade 40 on the side of the inlet opening. The stationary cutting surface 52 is inclined downwardly away from the blade 36. It forms an angle smaller than 90°, more particularly approximately equal to 80°, with a horizontal plane passing through the stationary cutting edge 58.

The stationary cutting edge 58 extends substantially parallel to the longitudinal edge 42. It is substantially rectilinear in the illustrated example. In the illustrated example, it has a length smaller than that of the inlet opening 14.

In the idle position, the blade 36 is positioned separated from the counter-blade 40 at least at its cutting edge 56 so as to allow the passage of the thread between the blade 36 and the counter-blade 40, more particularly between the cutting edges 56, 58. The movable cutting blade 36 extends on the side of an edge 22 of the inlet opening 14 opposite the longitudinal edge 42 along which the counter-blade 40 extends.

The cutting edges 56, 58 of the blade 36 and the counter-blade 40 are spaced apart from each other when the blade 36 is in its idle position. In particular, they extend on either side of the inlet opening 14.

In the active position, the blade 36 overlaps the counter-blade 40 over at least part of its length. In the illustrated example, in the active position, the blade 36 bears against the guide teeth 20. More particularly, the cutting area 48 of the blade 36 extends at least partially above the counter-blade 40. The lower surface of the blade 36 is in contact with the stationary cutting edge 58.

The moving mechanism for moving the blade 36 comprises a cam 60 secured to the bucket 8 and a cam follower 62 secured to the blade 36. The pivoting of the cam 60 around the pivot axis A of the bucket 8 causes the cam follower 62 to pivot around the pivot axis B of the blade 36.

In the illustrated example, the cam comprises a pin 60 protruding toward the outside of the bucket 8 from a side wall 12 of the bucket 8. The cam follower 40 comprises an inclined ramp 62 protruding downward from the blade 36, in particular from the actuating area 46 of the blade 36. The ramp 62 is inclined such that the pivoting of the bucket 8, and therefore the pin 60, around the pivot axis A toward the discharge position causes the blade 36 to pivot to the active position.

Elastic return means 66, formed in the illustrated example by a compression spring, are configured to return the blade 36 from its active position to its idle position when the bucket 8 moves from its discharge position to its pre-collection position. The compression spring is fastened to the blade 36, more particularly to the actuating area 46, by one of its ends and to the frame 6, in particular to the support piece 18 of the bucket 8, by the other one of its ends. It is compressed in the active position of the blade 36.

According to one embodiment, the anti-fraud system comprises pre-stressing means, capable of pre-stressing the movable cutting blade 36 against the counter-blade 40 along a direction normal to the movement plane of the blade 36.

Advantageously, the pre-stressing means comprise the compression spring. More particularly, the compression spring extends along an axis that is inclined relative to the movement plane of the blade 36 so as to bias the blade 36 toward the counter-blade 40.

Optionally, the pre-stressing means also comprise an additional pressure member capable of biasing the counter-blade 40 toward the blade 36 along the direction normal to the movement plane of the blade 36. This additional pressure member is secured to the frame 6. It assumes the form of an elastic tab 70 bearing on the blade 36 so as to press the blade 36 against the counter-blade 40. The elastic tab 70 is more particularly formed on an intermediate support plate 68 extending between the blade 36 and the support piece 18.

The method for recovering a coin attached to the end of a thread in the moneybox will now be explained.

Initially, the bucket 8 is in its pre-collection position. The blade 36 is in its idle position.

The user then inserts a coin attached to the end of a thread into the payment terminal 1 through the insertion slot 2. The coin passes through the selector 3, then is discharged through the outlet opening 24 of the selector 3 to fall into the bucket 8 under the effect of gravity. The thread then extends in the payment terminal 1 between the insertion slot 2 and the coin. It is engaged in the inlet opening 14 of the bucket 8. It in particular extends in the engagement area.

When the user validates the transaction performed using that coin, the moving means move the bucket 8 from its pre-collection position to its discharge position for discharging coins toward the moneybox. More particularly, they pivot the bucket 8 around the pivot axis A.

During that movement, the moving mechanism moves the blade 36 from its idle position to its active position under the action of the movement of the bucket 8. More particularly, the pivoting of the cam, in particular the pin 60, around the axis A causes the cam follower 62, and thus the blade 36, to pivot around the axis B and toward the active position.

When it moves toward the counter-blade 40, the blade 36 sweeps the inlet opening 14, in particular the engagement area of the inlet opening 14. Its cutting surface 50 grasps the thread engaged in the inlet opening 14 and moves it to the counter-blade 40. The thread is then stuck between the counter-blade 40 and the blade 36. The blade 36 then crosses the counter-blade 40 while sliding thereon so as to cut the thread by shearing between the counter-blade 40 and the blade 36.

Due to the incline of the stationary cutting surface 52, the blade 36 comes into contact only with the cutting edge 58 of the counter-blade 40 when it moves above the counter-blade 40.

Once the thread is cut, the coin falls through the bucket 8 and can be recovered in the moneybox.

When the bucket 8 reaches its discharge position, the blade 36 reaches its active position.

When the bucket 8 returns to its pre-collection position, the cam, i.e., the pin 60, ceases to be in contact with the blade 36. The blade 36 therefore ceases to be kept in the active position. The elastic return means then return the blade 36 to its idle position.

The pre-collection device 4 has then returned to its initial configuration in which the bucket 8 is in its pre-collection position and the blade 36 is in its idle position.

It is thus ready for a new transaction.

The anti-fraud system of the pre-collection device 4 according to the invention is particularly advantageous.

It is particularly reliable. Each time a transaction is validated, and therefore each time the bucket 8 is moved toward its collection position, the blade 36 is automatically moved to its active position, causing the cutting of any object that may be engaged in the inlet opening 14. Thus, the movement of the blade 36 toward its active position does not depend on any detection of an object engaged in the opening 14. It is done systematically, irrespective of whether an object is engaged in the opening 14.

The blade 36 is also able to cut the threads irrespective of their tension or rigidity. It is in particular capable of cutting untensioned and/or non-rigid threads.

Furthermore, the anti-fraud system is advantageously fully comprised inside the payment terminal 1. It is not visible or accessible from the outside of the payment terminal 1, which makes it difficult for a user to neutralize or bypass. Furthermore, its operation is transparent for the user of the payment terminal, who cannot detect its presence, since the system is not visible from the outside and also does not increase the processing time of the transactions.

The anti-fraud system is also inexpensive, not bulky, and particularly simple to implement, in particular on an existing payment terminal. In fact, one need only attach the movable blade and the counter-blade, as well as the moving mechanism, on an existing pre-collection device 4. In the embodiment described in reference to the figures, the addition of the moving mechanism simply involves attaching a pin 60 on the bucket 8, said pin forming the cam of that moving mechanism. The other parts of the moving mechanism are provided on the blade 36.

Providing a stationary cutting surface 52 that is inclined downwardly away from the blade 36 is advantageous. Indeed, the passage of the blade 36 on the counter-blade 40 creates a linear contact between the stationary cutting edge 58 and the blade 36. Thus, when it moves, the blade 36 rubs, with its lower surface, on the stationary cutting edge 58. This rubbing causes sharpening of the stationary cutting edge 58 each time the blade 36 moves, therefore each time the bucket 8 pivots. Thus, the system is self-sharpening, which is advantageous in terms of maintenance, since it avoids having to remove the anti-fraud system from the housing of the payment terminal 1 to sharpen the blades 36, 40.

Although this feature is not essential, it is also advantageous to provide means for pre-stressing the blade 36 against the counter-blade 40, in particular in the form of the elastic tab 70 or the inclined axis of the spring 66. In fact, such pressing increases the reliability of the cutting and reduces the need for maintenance operations due to undesired play between the blades 36, 40 during use of the payment terminal 1.

In the embodiment shown in the figures, the cutting surface 50 of the blade 36, and therefore the movable cutting edge 56, extends over only part of the length of the inlet opening 14. In particular, they extend on only one of the guide teeth 20 along the longitudinal direction of the opening 14.

Alternatively (not shown), the movable cutting surface 50, and therefore the movable cutting edge 56, extend over substantially the entire length of the inlet opening. In that case, it for example has a passage slot for each guide tooth 20.

The invention claimed is:

1. A pre-collection device for pre-collecting coins, intended for a payment terminal, the pre-collection device comprising a frame, a bucket having an inlet opening for inserting coins into the bucket and a discharge opening for discharging coins stored in the bucket, the pre-collection device comprising:

at least one cutting blade that is movable relative to the frame between an idle position and an active position and that is at least partially movable across the inlet opening between the idle position and the active position; and a moving mechanism for moving the movable cutting blade, capable of moving the movable cutting blade from the idle position to the active position so as to cut an object engaged in the inlet opening of the bucket, wherein the bucket is pivotably mounted relative to the frame around a bucket pivot axis between a pre-collection position, in which the bucket defines a temporary storage volume for the coins, and a discharge position for discharging coins through the discharge opening toward a moneybox of the payment terminal, the moving mechanism for moving the movable cutting blade being capable of moving the movable cutting blade from the idle position to the active position under the action of the movement of the bucket from said pre-collection position to said discharge position.

2. The pre-collection device according to claim 1, wherein the movable cutting blade is configured to move in the plane of the inlet opening of the bucket.

3. The pre-collection device according to claim 1, wherein the movable cutting blade is configured to sweep only one end of the inlet opening when the cutting blade is moved between the idle position and the active position.

4. The pre-collection device according to claim 1, wherein the movable cutting blade is pivotably mounted relative to the frame around a pivot axis between the idle position and the active position.

5. The pre-collection device according to claim 4, wherein the moving mechanism comprises a cam secured to the bucket and a cam follower secured to the movable cutting blade, the pivoting of the cam around the pivot axis of the bucket being capable of causing the cam follower to pivot around the pivot axis of the movable blade.

6. The pre-collection device according to claim 1, further comprising:

an elastic return member capable of moving the movable cutting blade from the active position to the idle position.

7. The pre-collection device according to claim 1, further comprising:

a counter-blade that is stationary relative to the frame, arranged to shear the object between the counter-blade and the movable cutting blade.

8. The pre-collection device according to claim 7, further comprising:

prestressing means, capable of pressing the movable cutting blade against the counter-blade along a direction normal to the movement plane of the movable cutting blade.

9. A payment terminal comprising a pre-collection device according to claim 1.

10. The pre-collection device according to claim 1, wherein the movable cutting blade is pivotably mounted relative to the frame around a pivot axis between its idle position and its active position.

* * * * *